US006537739B2

(12) United States Patent
Twist

(10) Patent No.: US 6,537,739 B2
(45) Date of Patent: Mar. 25, 2003

(54) PROCESSING PHOTOGRAPHIC MATERIAL

(75) Inventor: Peter J. Twist, Buckinghamshire (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/011,682

(22) Filed: Dec. 5, 2001

(65) Prior Publication Data

US 2002/0081535 A1 Jun. 27, 2002

(30) Foreign Application Priority Data

Dec. 21, 2000 (GB) ..... 0031194

(51) Int. Cl.[7] ..... G03C 5/26; G03C 7/30
(52) U.S. Cl. ..... 430/403
(58) Field of Search ..... 430/403

(56) References Cited

U.S. PATENT DOCUMENTS 3,232,195 A 2/1966 Chen ..... 396/580
3,379,879 A 4/1968 Dicker et al. ..... 378/169
4,623,235 A 11/1986 Lewis et al. ..... 396/598
5,217,854 A * 6/1993 Abe ..... 430/465
5,360,136 A 11/1994 Fyson et al. ..... 221/85
5,552,851 A * 9/1996 Koboshi et al. ..... 396/568

FOREIGN PATENT DOCUMENTS

JP 10198015 7/1998

* cited by examiner

*Primary Examiner*—Hoa Van Le
(74) *Attorney, Agent, or Firm*—Frank Pincelli

(57) ABSTRACT

A method of delivering processing solution to a processing device wherein the processing solutions are provided within sealed members fixedly arranged on a movable web. The web moves relative to the processing area and the sealed members are ruptured when the processing solution within is required.

15 Claims, 2 Drawing Sheets

PROCESSING PHOTOGRAPHIC MATERIAL

FIELD OF THE INVENTION

This invention relates to a method and apparatus for processing photographic material. In particular, the invention relates to a method of delivering processing solutions to a processor.

BACKGROUND OF THE INVENTION

Conventional processing of photographic material requires the use of large tanks of processing solutions. Each tank contains a processing solution such as developer, bleach, fixing solution or washing solution. The material is transported through each tank in turn. There is a tendency for the solutions to carry over from one tank to another leading to pollution of the solutions. Conventional processing has several other drawbacks. The temperatures which can be utilised are limited and therefore the process is slow. The composition of the solutions must be stable over long time periods in the processing tanks. Replenishment of the solutions is difficult to control. The processing apparatus is also very large due to the number of processing tanks.

To overcome the problems of conventional deep tank processing surface application of the processing chemicals was developed. In previous surface application methods a volume of solution is applied to the surface of the material being processed. However, previous surface application methods have several drawbacks.

In single use photographic processing machines deterioration of the processing solutions that can occur in large standing tanks is avoided by using small volumes of the processing solution to carry out a particular stage of the process. Once the stage is complete the solution is discarded. This requires that the solutions to be delivered must themselves be stable and not deteriorate by oxidation or evaporation. This can be accomplished by separating solutions into stable parts, mixing them just before use and also by using collapsible containers which prevent any major air ingress.

A process sequence or cycle is carried out by applying a succession of processing solutions according to a predetermined timing regime. The processing solutions can be supplied by a variety of means such as pumps and syringes. These means can be actuated automatically with a software control programmed according to any sequence or timing necessary. However, although this method is feasible it is complicated. The containers in which the solutions are stored must be substantially free from air to avoid deterioration. Pumps can fail or develop air bubbles which lowers the accuracy of the delivered volume. One way valves can stick and cause delivery failure. One way valves can also leak and cause delivery at the wrong time or position.

The method of the invention aims to overcome these problems and simplify delivery of the processing solutions. The method overcomes the problems by using a sequence of breakable sachets containing processing solution. The sachets are mounted on a flexible web in the order of the processing sequence.

SUMMARY OF THE INVENTION

According to the present invention there is provided a method of delivering processing solution to a processing device comprising the steps of, sealing a pre-measured volume of a processing solution within each of a plurality of sealed members, the sealed members being fixedly arranged on at least one movable elongate member and spaced apart along the length thereof in the order required for processing, the elongate member being movable relative to the processing area, and rupturing the sealed members in turn such that the processing solutions are released to the processing area in the correct order for processing.

The method of the invention is particularly useful for a type of single use device in which a single processing chamber is used for the whole process. A device of this type has been described in GB 0023091.2. In this device a small volume of processing solution is repeatedly spread on the surface of the photographic material until the time for the stage is reached after which the solution is removed by suction and the next solution is added. This is repeated for the entire process. The device consists of a rotating cylinder containing an agitation roller by means of which photographic material can be processed with very small volumes of solution. The processing solution can be very conveniently added onto the agitation roller by the method of the present invention.

In the method of the invention the volumes of processing solution are pre-measured at the site of manufacture of the sachets. The volumes should therefore be accurate. The pumps and valves required by conventional means of solution delivery are expensive, complicated and subject to variability. As these pumps and valves are eliminated the method is cheaper, less complicated and more reliable than conventional methods of solution delivery. In addition, since the processing solutions are sealed in the sachets prior to delivery they are free from aerial oxidation and evaporation.

A complete set of sachets to process one film can be linked together in the correct order of the processing stages and passed to the delivery point to be opened. This would always ensure the correct sequence of processing stages. In a single use processor the invention provides that a processing sequence can be changed by missing a particular stage by allowing the sachet to pass unopened.

In a single use processor the process can be very easily changed. For example, the process could be changed from colour negative to colour reversal by changing the pack of sachets and the software control. The same processor can therefore be used.

The handling of the processing chemicals is very easy and convenient since the chemicals are contained within the sachets.

Process control strips are not needed because the solutions are always fresh.

BRIEF DESCRIPTION OF THE DRAWINGS

The invention will now be described, by way of example, with reference to the accompanying drawings, in which.

DETAILED DESCRIPTION OF THE INVENTION

Figure 1A:
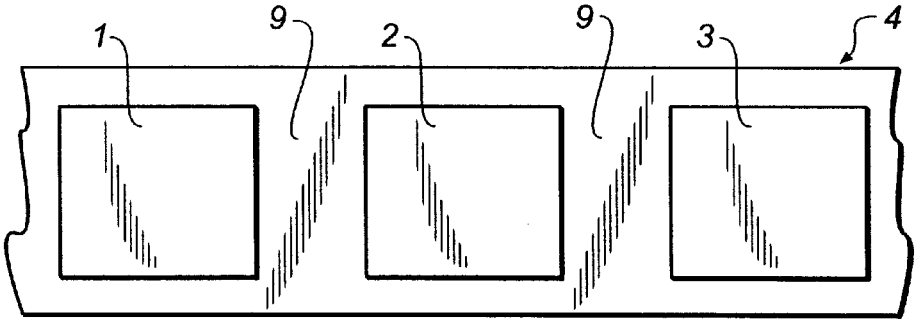
FIGS. 1A and 1B are schematic views showing how the sachets may be arranged in sequence.
Figure 1B:
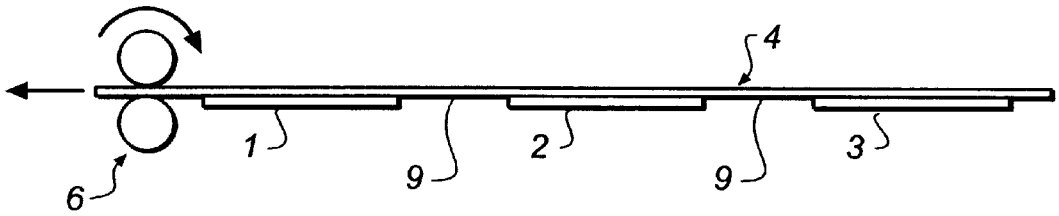

FIG. 1A shows a plan view of sachets of processing solution arranged in sequence. FIG. 1B shows a side view of sachets of processing solution arranged in sequence.

A movable web 4 is disposed above the material to be processed. The material is not shown in the drawings. A plurality of sachets, or sealed members, 1, 2, 3, are arranged on the movable web 4 in the order of the process cycle. The sachets may be made of any suitable material which is inert to the processing solutions. For example, the sachets may be made of a thin lead foil having a plastics coating or they could be of any suitable flexible plastics such as polythene or polypropylene. It will be understood that these are examples only.

The solutions in the sachets are pre-measured to the correct volume required for the process. In FIG. 1 sachet 1 holds developer, sachet 2 holds bleach and sachet 3 holds fix. It will be understood that further sachets could hold a wash solution or any other required solution. The sachets are fixed with respect to the web 4. The plurality of sachets are spaced apart from each other along the web 4. Numeral 9 denotes the gap between adjacent sachets. A pair of nip rollers 6 are provided for moving the web over a processing area.

When processing is to take place the pair of nip rollers 6 transport the web 4 in the direction shown by the arrow in FIG. 1B. As the first sachet reaches the rollers 6 the processing solution within the sachet is squeezed out and passes into the processing area, not shown. The web continues to move until the whole sachet has passed through the rollers and the gap 9 between sachets is located between the pair of rollers. The web then remains stationary until the processing solution held in the following sachet is required by the process. When the next solution is required the rollers 6 are re-activated and pull the web 4 and the next sachet inwards. The next processing solution is then squeezed out of its sachet as described above. This sequence continues until the processing is complete. The used sachets 1, 2, 3, and the web 4 are disposed of after use.

In FIGS. 1A and 1B single sachets are shown for the developer, bleach and fix stages. It will be understood that it is also possible to use more than one sachet for each stage. Thus the developer stage can have two or more sachets which are broken in sequence or simultaneously to deliver their contents into the processor.

In the embodiment shown in FIG. 1 the sachets are broken and the solution released therefrom by the pressure of the nip rollers 6. However it will be understood that any suitable means may be used to break open the sachet for the purpose of delivering the solution within to the process. For example, the sachets may be punctured by means of a punch or knife to release the solution therefrom.

Figure 2:
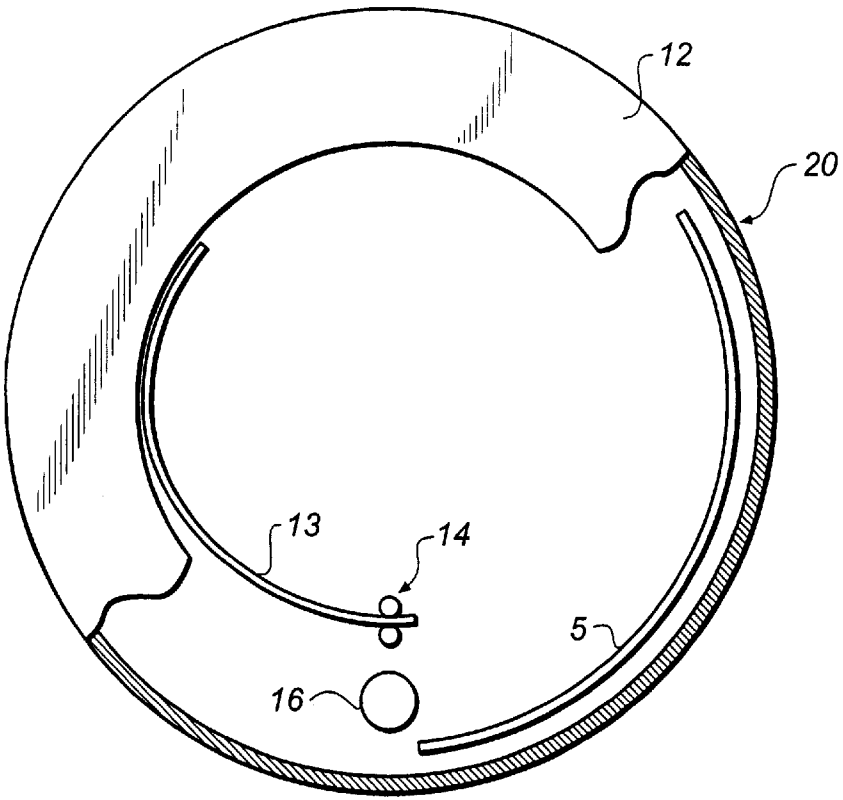
FIG. 2 shows how the sachets may be arranged in a processor.

FIG. 2 shows a processor in which the method of the invention may be performed.

The processor comprises a cylinder 20 having an open side or end and a closed side or end. The cylinder may be made of stainless steel, plastics or any other suitable material. The cylinder defines a processing drum chamber and is just wider than the film to be processed. A slot with a water tight cover (not shown) is provided through the wall of the cylinder to allow a strip of film 5 to be loaded into the drum chamber. A pair of pinch rollers are provided at the entry to the slot. The film sits on the inner circumference of the chamber with the emulsion side facing inwards. A drive shaft is provided at the closed side or end of the cylinder 20 for rotation thereof. The open end of the cylinder is provided with a flange 12. The flange retains solution within the processing chamber. Processing solutions may be introduced into the chamber and later removed from the chamber by suction. However any suitable means may be used.

An agitation roller 16 or other wave forming mechanism is provided in the lower part of the chamber. The roller surface rides just above the film surface (0.05–1.0 mm) and does not normally touch the film surface. It is however possible for the roller to sit directly on the emulsion surface of the film.

Further details of the processing chamber can be found in co-pending application GB 0023091.2, the contents of which are herein incorporated.

Figure 3:
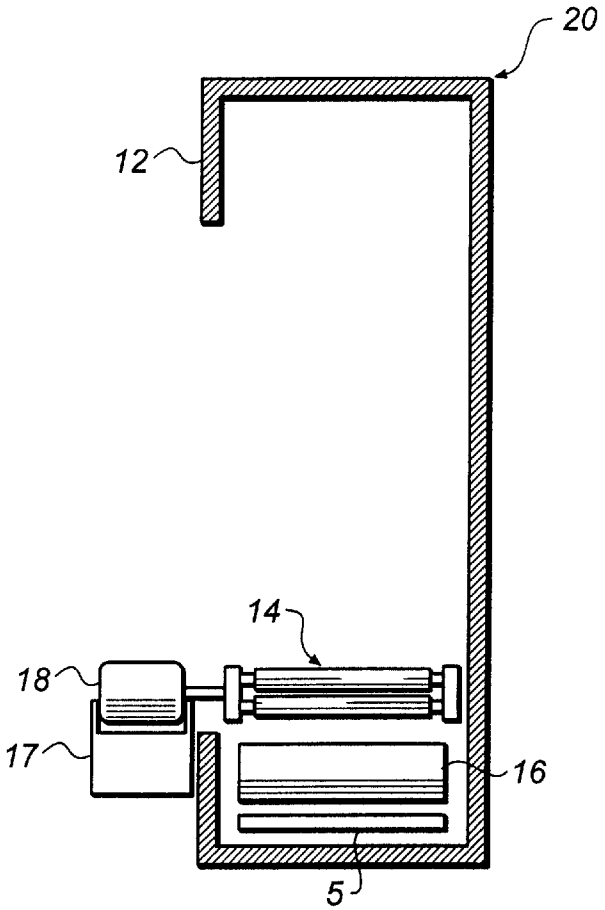
FIG. 3 is a schematic side view of the processor.

A plurality of sachets, or sealed members, are arranged on a movable web or strip 13 in the order of the process cycle as described above. Also as described above the plurality of sachets are spaced apart from each other along the web 13. The strip or web of sachets 13 lays on top of the front flange in an arc. Alternatively the strip may be held by a separate support and be kept stationary as the cylinder rotates. FIG. 3 illustrates how a pair of nip rollers 14 may be driven by a motor 18 located adjacent to the drum chamber. The motor 18 is located on support member 17.

In operation the film is loaded through the entry slot by the pinch rollers while the drum is stationary. The film is fed into the processing chamber with the emulsion side facing inwards. As the film is fed into the chamber it passes under the agitation roller 16. The film is passed in until the end of the film is reached when it is held by the pinch rollers . The film may be left attached to the cassette or detached from the cassette and driven in by rotation of a cylindrical member. Processing solutions are then added and removed as required in order to process the film as described below.

The strip of sachets 13 passes through the pair of nip rollers 14. The processing solution held within the sachet is thus squeezed out and released on top of the agitation roller 16. The roller provides very good agitation of the processing solution over the surface of the film. The process cycle is determined by the sequence of separate sachets. Each sachet has a known volume and type of processing solution. The nip rollers 14 are started and stopped in order to transport the strip of sachets 13 and to determine the correct timing of each stage of the process. Due to the gap between the sachets the web can be stopped after delivery of one solution until it is time to add the next solution.

In the device described here the entire process is carried out in the same vessel and after each stage the processing solution is removed by suction or other emptying means. After removal of the processing solution of one stage the solution for the next stage is added. Once the process cycle is finished the strip of empty sachets 13 is ejected from the processing device. The end of the strip of sachets is held in the nip rollers 14. The support member 17 is rotated through 90 degrees to deliver the empty supply strip of sachets into a collection bin or such like. This is one example of how the sachets may be removed from the chamber. It will be understood by those skilled in the art that any suitable means may be used.

It is possible to use one or more sachets for each stage. It is also possible to use separate webs of sachets for each stage, for example, a web of developer sachets which is transported and released in a similar way to that described above except that there are separate nip rollers for each web.

The method can be used for conventional colour negative materials. However, the process time of the invention is much shorter than conventional processes. For example, the developer stage in the C41 process is 195 seconds whereas the developer stage using the present invention can be from 15 seconds to 195 seconds. Similarly the bleach stage in conventional processing is typically 4.5 minutes whereas the bleach stage of the invention can be from 15 seconds to 4.5 minutes. The fix stage in conventional processing is typically 4.5 minutes whereas the fix stage of the invention can be from 15 seconds to 4.5 minutes. Therefore the present invention allows rapid colour negative processing.

Although the invention is designed primarily for single use processors it is clear that it can also be used for conventional processors. In conventional processors the processing solutions would be used as replenishers for large tanks and would be added at intervals in proportion to the amount of film processed.

The method can be used for any conventional photographic material such as, colour negative film and paper, colour positive film and paper, black and white film and paper.

The method is not applicable to diffusion transfer materials.

It is to be understood that various other modifications and changes may be made without departing from the scope of the present invention. The present invention being limited by the following claims.

PARTS LIST

1 sealed sachet
2 sealed sachet
3 sealed sachet
4 web
5 film
6 nip rollers
9 gap between sachets
12 flange
13 web
14 nip rollers
16 agitation roller
17 support member
18 motor
20 cylinder

What is claimed is:

1. A method of delivering processing solution to a processing device comprising the steps of; sealing a premeasured volume of a processing solution within each of a plurality of sealed members, the sealed members being fixedly arranged on at least one movable elongate member and spaced apart along the length thereof in the order required for processing, the elongate member being movable relative to the processing area, and rupturing the sealed members in turn such that the processing solutions are released to the processing area in the correct order for processing.

2. A method as claimed in claim 1 wherein the sealed members are ruptured by passing the elongate member through a pair of pinch rollers.

3. A method as claimed in claim 1 wherein the sealed members are ruptured by means of a punch.

4. A method as claimed in claim 1 wherein each sealed member holds a different processing solution.

5. A method as claimed in claim 1 wherein more than one sealed member may hold the same processing solution.

6. A method as claimed in claim 4 wherein the sealed members containing the same processing solution are ruptured simultaneously.

7. A method as claimed in claim 1 wherein the whole volume required to process a photographic material is supplied by the sealed members.

8. A method as claimed in claim 1 wherein the sealed members are made of a flexible plastics material.

9. A method as claimed in claim 1 wherein the sealed members are formed of a thin lead foil with plastics coating.

10. A method as claimed in claim 1 wherein conventional photographic materials can be processed in a single processing chamber.

11. A method as claimed in claim 10 wherein after a given processing stage is completed the volume of solution supplied by the sealed member is removed from the chamber.

12. A method as claimed in claim 11 wherein the next processing solution is added to the chamber by rupturing the next sealed member, that solution being removed from the chamber ready for the next processing solution and so on until the entire process is complete.

13. A method as claimed in claim 10 wherein the processing solution for a given stage is left in the processing chamber and the next processing solution is added on top of the already present solution or solutions.

14. A method as claimed in claim 13 wherein the processing solution are not removed until just prior to the wash stage.

15. A method as claimed in claim 10 wherein the process is a rapid process.

* * * * *